United States Patent [19]

Rimmi

[11] 4,446,356

[45] May 1, 1984

[54] ELECTRIC SAUNA HEATER

[75] Inventor: Pentti I. Rimmi, Hanko, Finland

[73] Assignee: Oy Helo Tehtaat, Hanko, Finland

[21] Appl. No.: 296,160

[22] Filed: Aug. 25, 1981

[30] Foreign Application Priority Data

Sep. 12, 1980 [FI] Finland ..... 802863

[51] Int. Cl.[3] ..... A61H 33/06; F24H 9/20; H05B 1/02

[52] U.S. Cl. ..... 219/272; 4/524; 219/365

[58] Field of Search ..... 219/362, 364, 365, 272; 4/524, 525, 526, 527, 528, 529, 530; 128/367, 368; 261/142; 236/46 F

[56] References Cited

U.S. PATENT DOCUMENTS

| | | | |
|---|---|---|---|
| 2,192,144 | 2/1940 | Miller | 236/46 F |
| 2,556,973 | 6/1951 | Nickells | 236/46 F |
| 3,007,178 | 11/1961 | Altman et al. | 4/525 |
| 3,066,668 | 12/1962 | Richter | 219/365 |
| 3,271,786 | 9/1966 | Joy | 4/532 |
| 3,275,800 | 9/1966 | Kuoppamaki et al. | 219/365 |
| 3,293,666 | 12/1966 | Casalini | 4/525 |
| 3,299,443 | 1/1967 | Ketola | 219/365 |
| 3,309,503 | 3/1967 | Dow et al. | 219/365 |
| 3,422,465 | 1/1969 | Jones et al. | 219/362 |
| 4,288,854 | 9/1981 | Burroughs | 236/46 R |
| 4,293,759 | 10/1981 | Higgins | 219/364 |

FOREIGN PATENT DOCUMENTS

| | | | |
|---|---|---|---|
| 732713 | 4/1966 | Canada | 219/365 |
| 910942 | 9/1972 | Canada | 219/365 |
| 2336358 | 2/1974 | Fed. Rep. of Germany | 4/524 |

OTHER PUBLICATIONS

"Installation Plans" by Normandy Products Co., Oct. 1, 1968.

"Solid State Controls" by John Mungenast, Oct. 1967.

*Primary Examiner*—Reynolds. B. A.

*Assistant Examiner*—Geoffrey S. Evans

*Attorney, Agent, or Firm*—Kenyon & Kenyon

[57] ABSTRACT

Disclosed is an electric sauna heater which includes control and safety apparatus which can include one or more relays (either temperature or current controlled) for switching power to the heating elements of the heater, a thermostat (mechanical or electronic) for controlling the relay(s), a temperature limiter to disconnect power from the heating elements in the event of excessive temperature, sensor elements for the thermostat and temperature limiter and operating controls. The operating controls can include a potentiometer for setting the thermostat, a potentiometer for setting the timer, light-limiting diodes as power indicators, and push buttons for manually energizing and de-energizing the sauna heater. According to the invention, the operating controls are disposed as a separate unit from heater unit and from the remainder of the control and safety apparatus either inside or outside of the sauna room. Conductors are provided to interconnect the operating controls with the remainder of the control and safety apparatus. Also disclosed is circuitry which enables the operating controls to operate at a low voltage of, for example, 12 volts.

10 Claims, 3 Drawing Figures

ELECTRIC SAUNA HEATER

BACKGROUND OF THE INVENTION

The present invention relates to an electric sauna heater and to control and safety means therefor.

An electric sauna heater includes control and safety means which can include one or more relays (e.g. temperature or current controlled) for switching power to the heating elements of the sauna heater, a thermostat (mechanical or electronic) for controlling the relay(s), a temperature limiter to disconnect power from the heating elements in the event of excessive temperature in the sauna room, sensor elements for the thermostat and temperature limiter, and operating controls for connecting and disconnecting power manually and/or by means of a timer and for setting the operating temperature desired.

Certain elements of the control and safety means for the sauna heater, specifically the relay(s) which switch power to the heating elements, cannot, due to present electric safety requirements, be installed in the sauna room as a separate unit from the heater unit which includes the heating elements. Consistent with such present safety requirements, the control and safety means of the sauna heater are being installed in any of the following manners.

1. A separate control center which includes the relay(s), thermostat, temperature limiter and the operating controls is positioned outside the sauna room with the sensor elements of the thermostat and the temperature limiter being brought into the sauna room from the control center.

2. A separate control center which includes the relay(s) and the operating controls is positioned outside the sauna room and a separate combination of a thermostat and a temperature limiter and the sensors thereof are positioned in the suana room.

3. The entire control and safety means except for the sensor elements of the thermostat and temperature limiter are installed in the same unit as the heating elements, i.e., in the heater unit, with the sensor elements of the thermostat and of the temperature limiter being led to the wall of the sauna room from the common heater unit.

The third alternative, of which a plurality of variations is possible, is the least expensive. However, all such variations are cumbersome and difficult to use and some may even be hazardous to users. Where the operating controls (e.g. knobs for setting the timer and the thermostat) are located in the lower portion of the heater unit, operation of those controls and reading of the scales of those controls are difficult because it is necessary for the person performing these operations to bend nearly down to floor level. If the operating controls are located in the upper portion of the heater or above it, the person operating the controls runs the risk of burning himself on the hot sauna stones (which can be at temperatures of 400° C. to 500° C.

OBJECTS AND SUMMARY OF THE INVENTION

It is another object of the present invention to provide an electric sauna heater which is safe to the user and eliminates the disadvantages described above.

It is another object of the present invention to provide an electric sauna heater having operating controls capable of operating at a low voltage.

According to the invention, the operating controls are provided as a separate unit from the heater unit and from the remainder of the control and safety means (including the relay(s)) with the operating controls, the heating elements and the remainder of the control and safety means being electrically coupled by conductor means. The operating controls can be installed at a desired location in the sauna room. The operating controls can also be disposed outside the sauna room, if desired.

The relay(s) can be disposed in the heater unit, as in the third alternative described above, or the relay(s) can be disposed outside of the sauna room as in the first and second alternatives described above.

In addition, the operating voltage of the operating elements (e.g. potentiometers, light-emitting diodes and push buttons) are preferably at a low voltage of, e.g., 12 v, so that the operating controls do not present a risk of electric shock to users.

An electric sauna heater according to the invention comprises a heater unit including heating elements in a sauna room and control and safety means therefor which include operating controls and means for switching power to the heating elements, the operating controls comprising a separate unit from the heater unit and from the switching means, the sauna heater further comprising means for electrically coupling the operating controls and the remainder of the control and safety means.

The switching means can be disposed in the sauna room as part of the heater unit or outside the sauna room as a separate unit.

The operating controls can be disposed in the sauna room, for example in a unit installed on the surface of or flush with a wall of the sauna room or on a guard rack for the heating elements or heater unit. The operating controls can also be disposed outside the sauna room, if desired.

The control and safety means in accordance with one aspect of the invention include circuit means coupled to and cooperating with the operating controls for controlling operation of the heating elements with a low voltage present at the operating controls. The low voltage can be, for example, 12 volts.

The control and safety means in accordance with another aspect of the invention include circuit means coupled to and cooperating with the operating controls for controlling operation of the heating elements with a line voltage present at the operating controls.

These and other objects, aspects, features and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like references indicate similar parts and in which.

DESCRIPTION OF THE PREFERRED EMBODIMENTS

Figure 1:
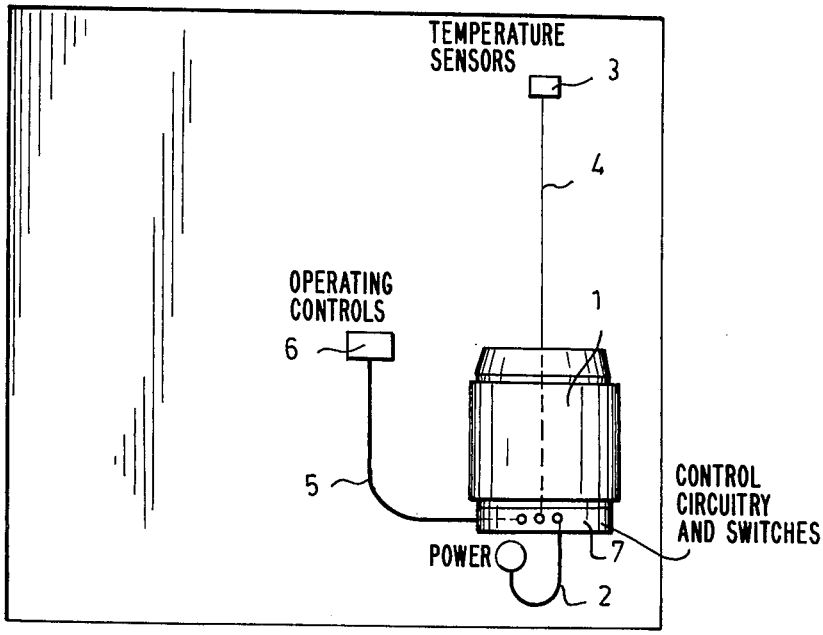
FIG. 1 is a diagram of an electric sauna heater according to one embodiment of the invention in which the operating controls are provided in the sauna room as a separate unit from the heater unit and the remainder of the control and safety means which, except for the sensor elements, are disposed in the heater unit.

Referring now to the drawings, FIG. 1 illustrates a sauna heater in which all of the control and safety means are disposed within the sauna room. The heating elements (not shown) of the sauna heater are disposed in a heater unit 1. The relays (not shown) for switching power to the heating elements of the sauna heater are located in control and safety means 7 also disposed in the same heater unit 1 as the heating elements. Power from an electric power network or source (not referenced) is connected by a cable 2 to the heating unit 1 through the control and safety means 7 which, as mentioned, include the relays for switching power from the cable 2 to the heating elements of heater unit 1. The relays include a relay controlled by temperature. The control and safety means 7 also include a thermostat for the temperature-controlled relay and a temperature limiter.

The sensor elements 3 of the thermostat and of the temperature limiter, which elements must be located in the upper portion of a sauna room, are connected to the control and safety means 7 by a fixed heat rresisting (e.g. 170° C.) cable or a capillary tube 4. A control box 6 containing the operating controls is connected to the control and safety means 7 in the heater unit 1 by a fixed conductor 5 of the sauna installation as a surface unit or as a flush (sunk) mounted unit.

Figure 2:
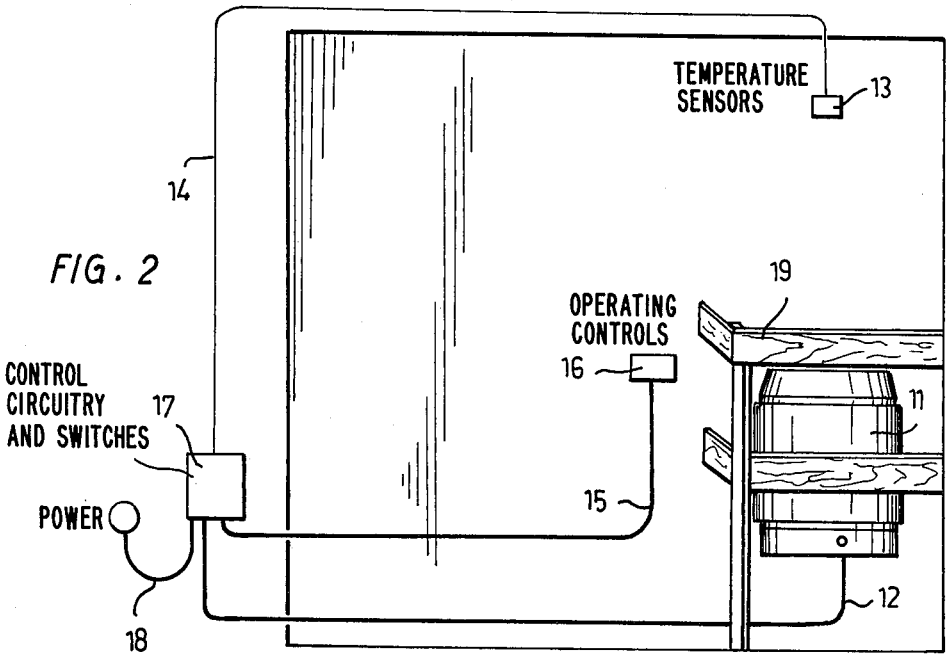
FIG. 2 is a diagram of an electric sauna heater according to another embodiment of the invention in which the operating controls are provided in the sauna room as a separate unit from the heater unit and from the remainder of the control and safety means which, except for the sensor elements, are disposed outside the sauna room.

FIG. 2 illustrates a sauna heater in which the relays, thermostat, temperature limiter and the connection of the control and safety means to an electric power network or source are located outside the sauna room while the operating controls and sensors are located in the sauna room as separate units from the heater unit. Control and safety means 17 which include the relays, thermostat and temperature limiter of a heater unit 11 are installed outside the sauna room and are connected to the heater unit 11 in the sauna room by a cable 12. A cable 18 connects the control and safety means 17 to an electric power network or supply (not referenced). The operating controls 16 are disposed in a control box located in the sauna room and connected to the remainder of the control and safety means 17 by a fixed conductor 15 of the installation. The control box can be mounted at a suitable place on the surface of a wall or flush within a wall of the sauna room, or on the guard rack 19 of the heater unit 11. Sensor elements 13 of the thermostat and of the temperature limiter are installed in the upper portion of the sauna room, as in the FIG. 1 arrangement, and connected to the control and safety means 17 of the heater by a heat resisting (e.g. 170° C.) cable 14, for example.

Figure 3:
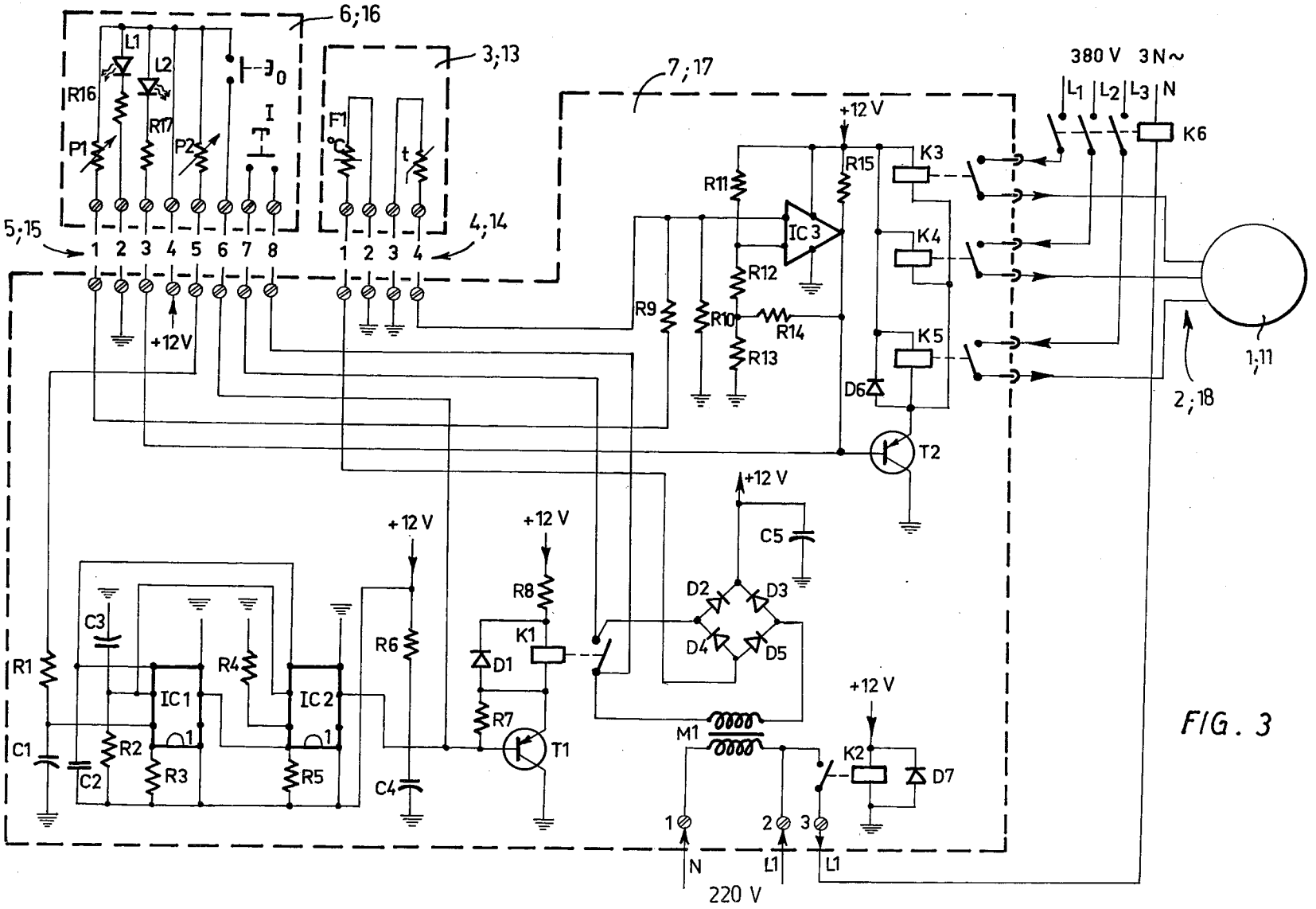
FIG. 3 is a schematic circuit diagram of control and safety means according to the invention which can be utilized in the electric sauna heaters of FIGS. 1 and 2.

FIG. 3 illustrates an embodiment of control and safety means which can be utilized in the arrangements of FIGS. 1 and 2.

The blocks set off in FIG. 3 by dashed lines are designated by reference numerals which correspond to like numbered boxes and elements shown in FIGS. 1 and 2.

The operating controls of the sauna heater are located in block 6; 16 of FIG. 3. For example, push buttons I and O can be provided for connecting and disconnecting power to the sauna heater; a potentiometer P1 can be provided to set the temperature at which the thermostat is to switch the relays; and a potentiometer P2 can be provided to set a timer which operates the relays to disconnect power from the sauna heater at the expiration of the time set by potentiometer P2. Light emitting diode L1 can be provided to indicate that current is connected to the sauna heater and light emitting diode L2 can be provided to indicate that the heating elements (resistors) of the heater are energized.

Momentarily depressing push button I switches power to the sauna heater by initially closing the secondary circuit of transformer M1 to supply an ac voltage from the transformer M1 to diodes D2-D5 of a bridge rectifier circuit. Diodes D2-D5 rectify the ac voltage and with capacitor C5 provide 12 volts dc as a supply which is fed to other components as shown in FIG. 3. The 12v dc is initially supplied to transistor T1 through resistor R8, the coil of relay K1 and resistor R7 to cause transistor T1 to conduct. Current flowing through the collector circuit of transistor T1 also flows through the coil of relay K1 to actuate the relay. Relay K1 remains actuated as long as transistor T1 is conducting. Current is thereby permanently connected to the sauna heater.

The coil of relay K2 is connected between the 12v supply and ground. Therefore, the presence of the 12v supply at the coil of relay K2 energizes it and connects line L1 to the neutral N through the coil of relay K6. Relay K6 is thereby energized and connects the three phase line, L1, L2, L3 to the contacts of K3-K5, respectively.

Push button O switches the sauna heater off. Momentarily depressing push button O connects 12v dc to the base of the transistor T1 which causes it to switch to a non-conducting state, thereby de-energizing the coil of relay K1 and opening the secondary circuit of transformer M1. This de-energizes relays K2 and K6 and causes current to be disconnected from the sauna heater.

The operating range of the thermostat is set by means of the potentiometer P1 which is connected through a resistor R9 to an operational amplifier IC3. A temperature dependent resistor (thermistor) t in block 3;13, resistors R9 and R10 in block 7;17 and the potentiometer P1 form a voltage divider which divides the 12v dc supply present at terminal 4 block 6;16 and provides a control signal which is fed to operational amplifier IC3. The output signal from operational amplifier IC3 is fed to the base of transistor T2 and controls its conductivity. When transistor T2 is conducting, the coils of relays K3, K4 and K5 are energized to actuate the relays and connect three phase current from relay K6 to the heating elements or resistors of the heater unit 1;11 through conductors 2;18. As the temperature in the sauna room varies, the resistance of the thermistor t changes to correspondingly change the input signal to operational amplifier IC3. Thus, the thermistor t controls the operational amplifier IC3 which in turn controls the state of conductivity of the transistor T2 and, consequently, the positions of relays K3, K4 and K5.

A thermal fuse F1 in block 3;13 constitutes the temperature limiter. If the temperature in the sauna room should rise to an excessive value, fuse F1 melts and disconnects one end of the bridge rectifier (D2-D5) from ground, thereby disconnecting the 12v supply which causes all relay coils to become de-energized and current to the sauna heater to be disconnected.

Block 7;17 also includes an electronic timer which comprises integrated circuits IC1 and IC2 and associated components. Electronic timers are well known in the art and therefore the timer shown in FIG. 3 will not be described in detail. The output of the timer is connected to the base of transistor T2 to control its conductivity and thereby the state of relay K1. The timer is controlled by a potentiometer P2, as mentioned above. After the expiration of a time determined by the resistance value set in potentiometer P2 in cooperation with the values of the associated components, the output of the timer circuit causes transistor T1 to become non-conducting and disconnects current from the sauna heater, as described above.

As described above, the invention permits the voltage present at the operating controls to be a low voltage of, for example, 12v. However, normal line voltage can also be used. The invention also permits a low voltage to be present at the sensor elements (for example a thermistor and a thermal fuse) of the thermostat and the temperature limiter.

Because the control box 6,16 according to the invention contains only operating controls and indicators (potentiometers, light-emitting diodes and push buttons) of the control and safety means, it is quite compact as compared to conventional control centers, the volume being about 95 percent smaller. As a result of this small size, the control box can, when flush (sunk) mounting is used, be installed by using a conventional instrument box. Such a control box can, if desired, also be installed as a normal low voltage installation outside the sauna room.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purposes of the disclosure without departing from the spirit and scope of the invention.

What I claim is:

1. An electric sauna heater comprising:

a heater unit adapted to be disposed in a sauna room and including heating elements;

switching means coupled to said heating elements for connecting power to said heating elements;

controlling means coupled to said switching means for controlling operation of said switching means, said controlling means including circuitry operable at a low voltage relative to the voltage of the power connected to the heating elements;

operating controls for the sauna heater coupled to said circuitry operable at a low voltage of said controlling means, said operating controls being disposed as a separate unit from said switching means, said controlling means and said heater unit so that a low voltage is present at said separate unit for said operating controls; and means for coupling said operating controls and said controlling means.

2. An electric sauna heater as claimed in claim 1 wherein said controlling means include thermostat means for controlling said switching means in response to temperature and timer means for controlling said switching means in response to time, and wherein said operating controls comprise a manually operated switch for manually controlling said switching means to connect and disconnect power to the heating elements, a potentiometer for said thermostat means, a potentiometer for said timer means and t least one indicator light indicating the operating state of said heating elements.

3. An electric sauna heater as claimed in claim 1 or 2, wherein the switching means comprises part of the heater unit.

4. An electric sauna heater as claimed in claim 1 or 2, wherein the switching means comprises a separate unit from the heater unit and is adapted to be disposed outside the sauna room.

5. An electric sauna heater as claimed in claim 1 or 2, wherein the operating controls are adapted to be disposed in the sauna room.

6. An electric sauna heater as claimed in claim 5, where the operating controls are disposed in a unit adapted to be installed on the surface a wall of the sauna room.

7. An electric sauna heater as claimed in claim 5, wherein the operating controls are disposed in a unit adapted to be installed on a guard rack for the heater unit.

8. An electric sauna heater as claimed in claim 5, wherein the operating controls are disposed in a unit adapted to be installed flush with the wall of the sauna room.

9. An electric sauna heater as claimed in claim 1 or 2, wherein the operating controls are adapted to be disposed outside the sauna room.

10. An electric sauna heater as claimed in claim 1, wherein the low voltage is 12 volts.

* * * * *